United States Patent [19]

Propheter

[11] Patent Number: 4,594,926

[45] Date of Patent: Jun. 17, 1986

[54] FILE HOLE PUNCH RING APPARATUS FOR WEB FED PAPER CONVEYING MECHANISM

[75] Inventor: Howard L. Propheter, Emporia, Kans.

[73] Assignee: Didde Graphic Systems Corporation, Emporia, Kans.

[21] Appl. No.: 544,528

[22] Filed: Oct. 24, 1983

[51] Int. Cl.[4] ..... B26D 1/62

[52] U.S. Cl. ..... 83/345; 83/348; 83/670; 83/677; 83/699

[58] Field of Search ..... 83/345, 348, 690, 691, 83/670, 680, 685, 677, 699, 700, 337

[56] References Cited

U.S. PATENT DOCUMENTS

| | | | |
|---|---|---|---|
| 617,012 | 1/1899 | Griffin | 83/677 |
| 2,220,270 | 11/1940 | Page | 83/677 |
| 2,797,754 | 7/1957 | Bornemann | 83/345 |
| 3,064,513 | 11/1962 | Hershey | 83/345 |
| 3,106,859 | 10/1963 | Huffman | 83/345 |
| 3,683,736 | 8/1972 | Loose | 83/337 |
| 3,706,250 | 12/1972 | Herd | 83/345 |
| 3,949,653 | 4/1976 | Schröter | 83/337 |

*Primary Examiner*—Frank T. Yost
*Assistant Examiner*—Hien H. Phan
*Attorney, Agent, or Firm*—Schmidt, Johnson, Hovey & Williams

[57] ABSTRACT

A punch ring apparatus particularly useful in a printing operating involving web fed paper is provided which is easily adapted for punching file holes, line holes, or a wide variety of hole patterns in the moving paper web, thereby substantially reducing makeready times and associated costs. The punch ring hereof preferably includes a plurality of radially-oriented, spaced-apart punches mounted in the punch ring and radially shiftable between an outermost punch position and a retracted position, with the punches being spring biased into the retracted position. The punch ring preferably includes an annular concentric groove in an axial face thereof, with the proximal ends of the punches extending into the groove when the punches are in the retracted position. One or more annular camming rings are received in the groove and configured such that axial rotation of a camming ring will outwardly shift one or more of the punches into the punch position to produce the desired hole punch pattern. Complementally, the die ring of the present invention is configured for operation with any of the hole punch patterns selectable on the punch ring. Thus, the operator can quickly and easily reconfigure the punch ring apparatus hereof for a different hole punch pattern in a minimum amount of makeready time.

12 Claims, 5 Drawing Figures

10
12
14
16
18
20
22
26
28
30
32
34
36
38
40
41
42
44
46
48
52
54
56
58
60
62
64
66
69
72
74
76
78
80
82
84
86
87
88
90
92
94
98
100
102
104
106
108
110
112
114
116
118
120
122
124
2.
4.
5.

FILE HOLE PUNCH RING APPARATUS FOR WEB FED PAPER CONVEYING MECHANISM

BACKGROUND OF THE INVENTION

1. Field of the Invention

This invention relates to a hole punching apparatus of the type normally associated with a printing operation involving web fed paper, with the apparatus hereof being designed for selective operation whereby the operator can easily and quickly change from one hole punch pattern to a different hole pattern, thus substantially reducing makeready times and the attendant costs. More particularly, it is associated with a punch ring apparatus having a plurality of radially-oriented, spaced-apart punches shiftably mounted in the punch ring whereby the punches can be selectively positioned for punching or retracted into an inoperative position according to the hole pattern desired.

2. Description of the Prior Art

Many different types of punching units have been utilized in the past in the printing industry for punching holes in a continuously moving web of paper. Such punching units, have typically been incorporated as a modular unit in the bindery section of a printing operation, or alternatively, incorporated into a separate bindery unit. Such punch units are designed with the capability of punch file holes, line holes, or special patterns. The file hole punch is typically used for widely spaced holes, with a variety of hole sizes being available. For example, a typical loose leaf might include three relatively large widely spaced-apart holes. The line hole punch is for a continuous stream of closely spaced holes along the marginal edges of the moving web, particularly useful for providing a means for engaging the web with a driving sprocket, etc. As can be appreciated, a variety of hole patterns in a moving web may be called for, depending on the particular job requirements.

Such past punch units have typically included a pair of drive shafts mounted on either side of the web path of travel with a punch ring mounted on the uppermost shaft and a die ring mounted on the lowermost shaft in general vertical alignment relative to the horizontally moving web. Depending on the hole pattern desired, a coordinated pair of punch and die rings would be mounted on the respective shafts. That is, if line holes were desired, a line hole punch ring would be mounted on the uppermost shaft and a line hole die ring would be mounted on the lowermost shaft, with the rings aligned relative to the web for the proper positioning of the holes. The rings are typically split into two halves, such that when they are joined together about the shaft each ring presents a circular in cross-section roller arrangement with the web passing through the nip between the two circular rings. The die ring of such an arrangement presents a plurality of circumferentially spaced-apart, radially-oriented, dies secured in the die ring around the outer periphery. The punch ring includes a plurality of circumferentially spaced-apart, radially oriented bores with the die ring and punch ring positioned on their respective shafts such that when the shafts are rotated, the bores and the dies will vertically align themselves when passing through the nip between the two rings. Elongated punches are then inserted in the bores of the punch ring according the hole pattern desired. Thus, in operation, the moving web travels through the nip between the two rings and the rings rotate such that the punches shear through the paper into an aligned die creating the desired holes in the web.

A number of problems exist with such past punching operations, the most noteworthy being the significant amount of makeready time associated with setting up such punch and die rings. As can be appreciated, a significant amount of setup time is required to set up the punch unit for a different hole pattern. Thus, if it is desired to change over from a line hole operation to a file hole operation, the operator must first remove the line hole punch ring and the line hole die ring, and then install a file hole punch ring and a file hole die ring. Such installation includes vertically aligning the rings, inserting the punches in the bores of the punch ring according to the desired pattern, properly seating the punches in the respective dies, and finally threading the web through the nip to begin operation.

As those skilled in the art will appreciate, the makeready time associated with setup for a different hole pattern can be significant and expensive. Particularly for commonly used hole patterns, it would be a significant advance in the art if a punch unit were devised which could be quickly changed over to a different hole punch pattern.

SUMMARY OF THE INVENTION

The problems outlined above are in large measure solved by the punch ring apparatus in accordance with the present invention. That is to say, the punch ring hereof is quickly and easily configured for a variety of hole punch patterns. Thus, the significant makeready times associated with such past punch units are substantially reduced by the punch ring of the present invention.

The punch ring in accordance with the present invention broadly includes an annular support ring having a plurality of radially-oriented, circumferentially spaced-apart elongated bores therein with an elongated punch means operatively received in a respective bore. Advantageously, each punch is shiftable between an extended, punching position and a retracted, inoperative position. The device includes structure for radially-inwardly biasing each punch into the retracted position and means for selectively radially-outwardly shifting one or more of the punches into the punching position. Thus, the device hereof allows for selectively positioning punches into the punching position according to the desired hole pattern without the makeready times associated with such past punch units.

Preferably, the support ring includes an annular, concentric, groove in an axial face thereof with the bores extending radially-inwardly from the support ring outermost surface to the groove. The punches of the preferred device present an outwardlyoriented punch face at the distal end thereof and a cam follower at the proximal end thereof, with the cam follower extending into the support ring groove when the respective punch is in the retracted position. The punches are selectively shifted into the punching position by an annular camming ring operatively received in the groove. Advantageously, the camming ring presents an outermost camming face having one or more radially outwardly extending undulate driving surfaces. Included in the preferred device is a means for selectively axially rotating and positioning the camming ring such that a driving surface will engage a respective cam follower thereby outwardly shifting the respective punch into the punching position.

In particularly preferred forms, the camming ring includes a plurality of teeth along a portion of the outermost camming face such that a complemental sprocket tool can engage the teeth and rotation of the sprocket tool will axially rotate the camming ring. The preferred embodiment of the present invention includes two or more camming rings juxtaposed in the groove. With two camming rings presented, the outermost camming ring has an inwardly-extending cutout portion in the outermost camming face thereby exposing the teeth of the innermost camming ring for the complemental reception of the sprocket tool. Advantageously, in the preferred embodiment the support ring includes an elongated pin secured within the groove and each camming ring having an arcuate slot extending therethrough whereby the pin is operatively received within the slots. This cooperative engagement of the slots around the pin limits the amount of axial rotation of the respective camming ring allowing the operator to more easily position the camming rings according to the desired punching configuration.

DESCRIPTION OF THE PREFERRED EMBODIMENT

Figure 1:
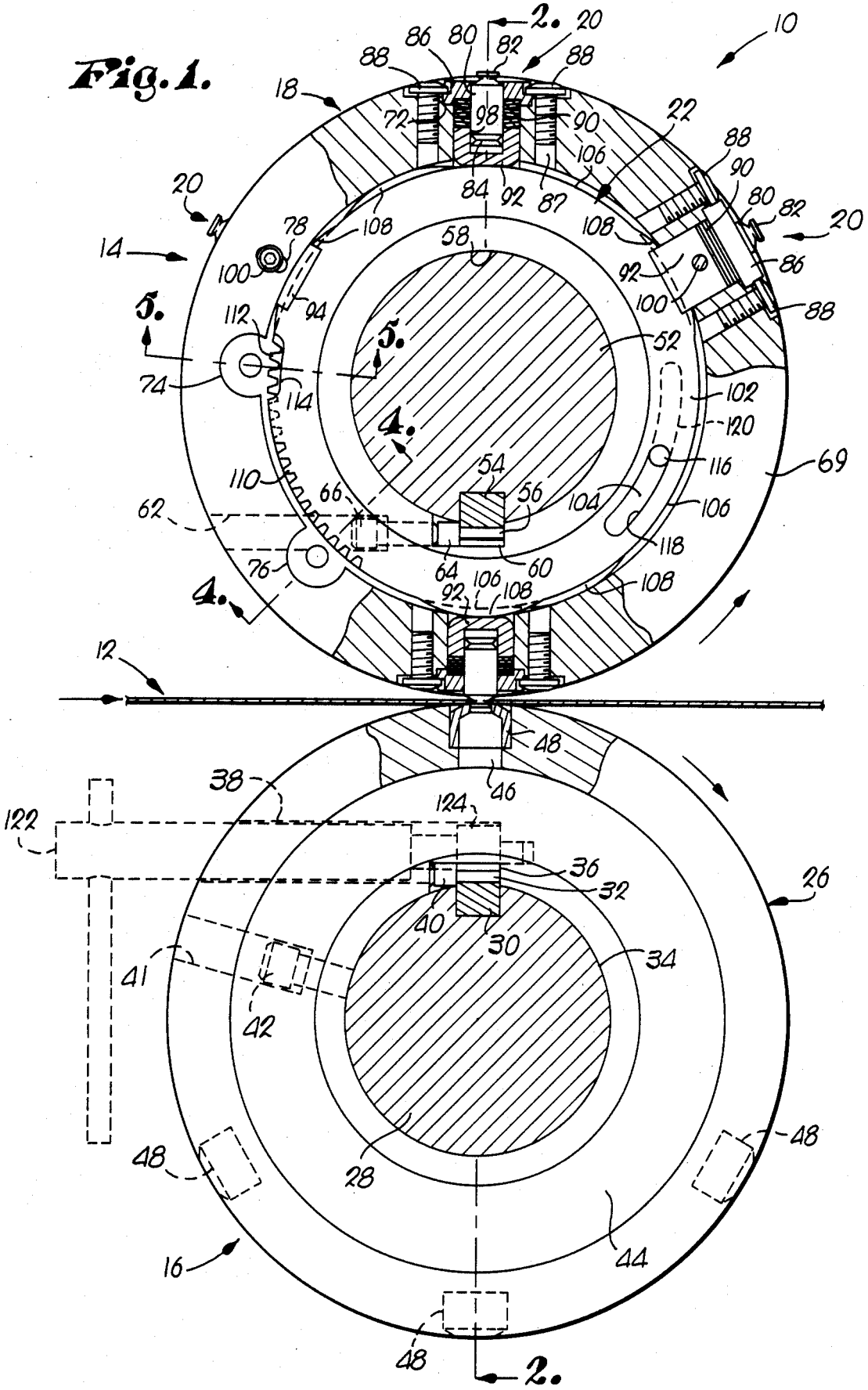
FIG. 1 is a vertical sectional view with parts broken away for clarity, of the device of the present invention and particularly illustrates the relative disposition of the punch ring, die ring and web passing through the nip therebetween.

Referring now to the drawing, a punch unit 10 in accordance with the present invention is illustrated performing a punching operation on a web of paper 12 moving along a path of travel (left to right in FIG. 1). Broadly speaking, the punch unit 10 presents a punching mechanism 14 on one side of the web 12 (upper side in FIG. 1) and a die mechanism 16 on the other side of the web 12 (lower side viewing FIG. 1). The predominant structural features of the punching mechanism 14 include an annular punch ring 18, a punching apparatus 20, and a shifting structure 22 as will be more fully explained in some detail.

Figure 2:
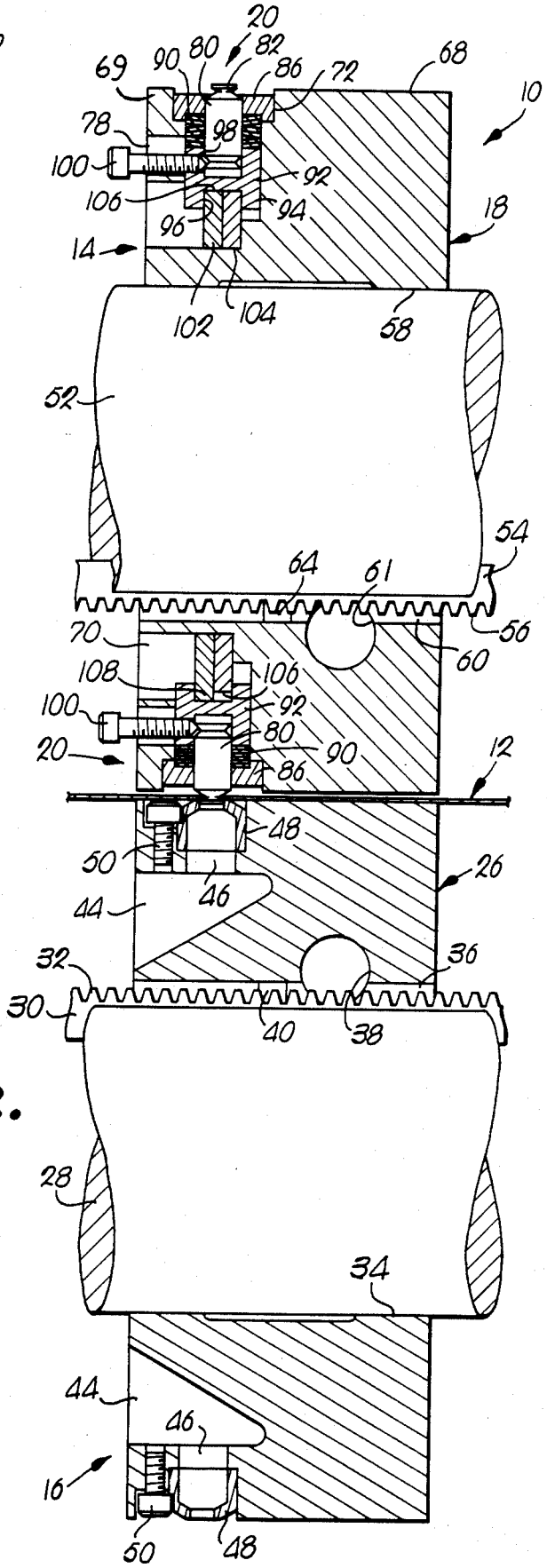
FIG. 2 is a vertical sectional view taken along line 2—2 of FIG. 1 and depicts the orientation of the punch and die rings about their respective drive shafts and further shows two camming rings received in the groove of the die ring.

Turning first to the die mechanism 16, FIGS. 1 and 2 illustrate the die mechanism 16 of the preferred embodiment, which will be recognized as quite similar to conventional die mechanisms in current use. That is, die mechanism 16 includes an annular die ring 26 mounted on an elongated, revoluble cylindrical die shaft 28. For this purpose, the die shaft 28 includes an elongated, longitudinally oriented groove in which an elongated key bar 30 is received, with the key bar 30 presenting a plurality of upstanding teeth 32 along the length thereof as seen in FIG. 2. As can be appreciated, the annular nature of the die ring 26 presents an innermost generally circular mating surface 34 dimensioned for sliding engagement onto the die shaft 28, and including structure defining a substantially rectangular in cross-section key way 36 extending into the mating surface 34 such that the key bar 30 is operatively received in the key way 36 (see FIG. 2).

Advantageously, the die ring 26 includes an inwardly-extending passageway 38 substantially along a chord line relative to the generally circular in cross-section die ring 26 as shown in FIG. 1, with the passageway 38 terminating when reaching the key way 36. Juxtaposed to the key bar 30 adjacent the passageway 38 is a locking key 40 which incorporates a key set screw of the conventional variety. Additionally, the die ring 26 includes a radially oriented passageway 41 for the operative reception of a shaft set screw 42 as shown in phantom in FIG. 1.

The die ring 26 further includes an inwardly-extending annular groove circumscribing the shaft 28 to define a chad disposal chute 44. As illustrated in FIG. 1, the die ring 26 includes four countersunk bores 46 extending from the outer circumference of the die ring 26 into the chad disposal chute 44, with a hardened steel, apertured die insert 48 received in each of the bores 46. Each die insert 48 is retained in the bores 46 by a cap screw 50 as shown in FIG. 2.

Turning now to the punching mechanism 14, the punch ring 18 is mounted on a revoluble punch shaft 52 in a similar manner to the joinder of the die ring 26 to the die shaft 28. That is, the punch shaft 52 presents an elongated longitudinally oriented groove which operatively receives an outwardly-extending elongated key bar 54 having teeth 56. The annular nature of the punch ring 18 presents an innermost concentric mating surface 58 dimensioned for sliding engagement over the punch shaft 52, with a key way 60 in the punch ring 18 operatively receiving the key bar 54. As shown in FIG. 2, an elongated passageway 61, similar to the passageway 38 of the die ring 26, extends into the punch ring 18 to provide access to the key bar 54 for adjustment. As depicted in FIG. 1, the punch ring 18 is locked in place relative the shaft 52 by means of a locking key 64 and key set screw 66. To this end, an elongated passageway 62 along a chord line relative the punch ring 18 is included for providing access to set screw 66. A radially-oriented bore (not shown) operatively receiving a shaft set screw completes the joinder of the punch ring 18 to the punch shaft 52 when the screw is tightened. The bore and set screw of the punch ring are similar to the passageway 41 and set screw 42 of the die ring 26, but for clarity, not shown in FIG. 1.

Figure 3:
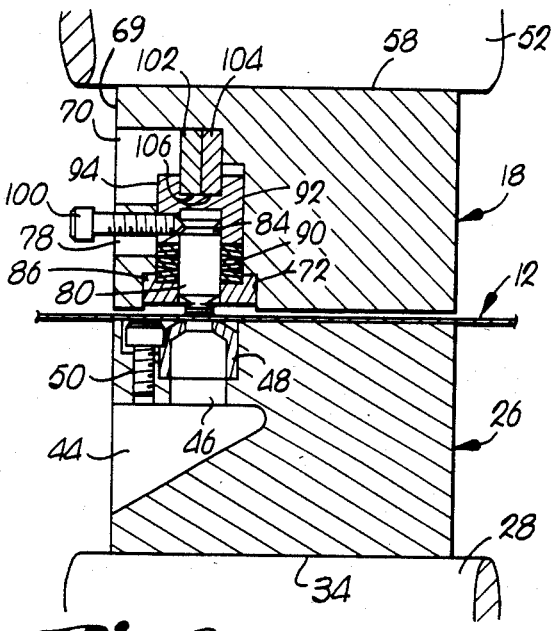
FIG. 3 is a vertical sectional view similar to FIG. 2, but illustrates a punch in the retracted position.
Figure 4:
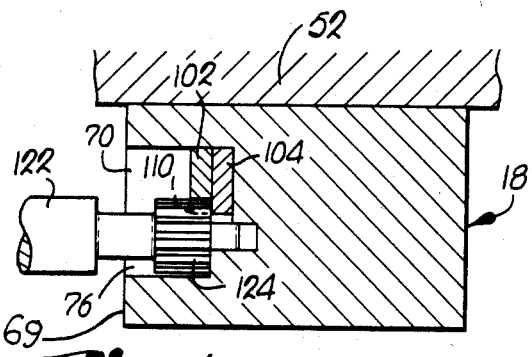
FIG. 4 is a sectional view taken along line 4—4 of FIG. 1 and depicts a sprocket tool operatively engaging the teeth of the outermost camming ring.
Figure 5:
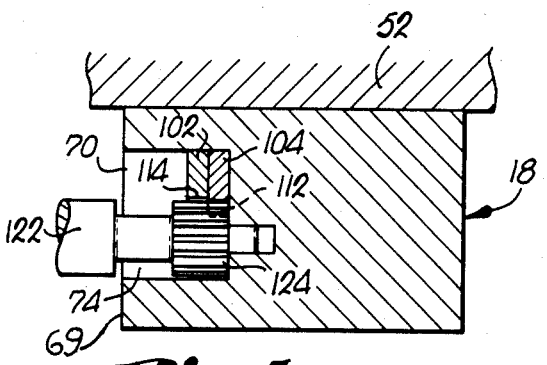
FIG. 5 is a sectional view taken along line 5—5 of FIG. 1 to illustrate the operative engagement of the sprocket tool with the teeth of the innermost camming ring.

In more detail, the punch ring 18 includes an outermost, web engaging annular surface 68 and structure defining an annular groove 70 in one axial face 69 of the punch ring 18; advantageously, the groove 70 is in concentric and circumscribing relationship to the shaft 52 (see FIGS. 1, 2). Four radially-oriented, countersunk bores 72 are provided in the punch ring 18 and extend from the outer surface 68 into the groove 70. As seen in FIGS. 1, 4, 5, two generally cylindrical in cross-section elongated tool reception cavities 74, 76 extend into the axial face 69 of the punch ring 18 in communicating relationship with the groove 70. Additionally, the punch ring 18 includes structure defining plurality of slots 78 adjacent the groove 70, each slot 78 extending from the axial face 69 of the punch ring 18 into communication with a respective bore 72 (see FIGS. 1–3).

Operatively received in each of the four bores 72 is a punching apparatus broadly denoted as 20. Each punching apparatus 20 includes an elongated punch 80 preferably made of a soft steel and having a shearing structure 82 at the distal end thereof and a circumscribing retaining groove 84 adjacent the proximal end. An apertured locking plate 86 is interfitted around the punch 80 and disposed in the countersunk portion of the bore 72 slightly below the outer surface 68. A pair of threaded apertures 87 on each side of the respective bore 72 is provided for the threading reception of the cap screws 88, thereby retaining the locking plate 86 as shown in FIG. 1. Belleville springs 90 are interfitted around each punch 80 adjacent the plate 86, while a cam follower receives the proximal end of the punch 80 and adjoins the belleville springs 90. In more detail, cam follower 92 presents a pair of legs 94 presenting an H-shaped cross-section as seen in FIG. 2 to define a proximal, cam receiving slot 96 between the legs 94 and a distal, punch receiving, circular in cross-section aperture 98. Advantageously, the outermost leg 94 adjacent slot 78 includes a threaded aperture for the reception of a cap screw 100. As can be appreciated, the cap screw 100 extends through the slot 78, outermost leg 94, and into the retaining groove 84 for retaining the punch 80 to the cam follower 92.

Shifting structure 22 of the preferred embodiment includes an outermost camming ring 102 and an innermost camming ring 104 received in the groove 70 of the punch ring 18. Each camming ring 102, 104 presents an outermost camming face 106 having a plurality of radially-outwardly extending, undulate driving surfaces 108. As seen in FIGS. 1–3, the slot 96 of each cam follower 92 operatively receives the face 106 of each ring 102, 104. Each camming ring 102, 104 further includes a plurality of teeth 110, 112 along a portion of the outermost camming face 106 (see FIG. 1). Advantageously, the camming rings 102, 104 positioned in the groove 70 such that the teeth 110, 112 are adjacent the respective tool reception cavities 74, 76. Further, the outermost camming ring 102 has an inwardly-extending cutout portion 114 in the camming face 106, which by aligning the cutout portion 114 with the tool reception cavity 74 exposes the teeth 112 of the innermost camming ring 104 (see FIG. 1). Further, as illustrated in FIG. 1, an elongated cylindrical pin 116 is orthogonally received in the groove 70 parallel to the shaft 52, which each camming ring 102, 104 including an arcuate slot 118, 120 respectively receiving the pin 116, as shown in FIG. 1. Additionally, as shown in phantom in FIG. 1, an adjustment tool 122 is provided and includes a sprocket 124 on one end thereof. As will be made clear, the tool 122 is useful in setup of the punch unit 10 of the present invention.

In operation, the punch unit 10 of the present invention is preferably positioned in the bindery section of a printing press operation, for example, as a modular unit thereof. In this regard, the punch unit 10 of the present invention performs essentially the same function as punching units previously known, but provides the user with many advantages including a substantial reduction in makeready time. The punch unit 10 described in the preferred embodiment is designed to be easily shiftable between a three hole punch pattern in a given length of web and a two hole punch pattern in the same length of web. As those skilled in the art will appreciate, many alternative embodiments for the present invention are possible to accommodate different hole patterns or sizes.

In setup, the punch unit 10 of the present invention is first positioned laterally relative to the web 12 according to the desired location of the punch holes. Thus, with the shaft set screws and the locking keys 40, 64 of the punching mechanism 14 and die mechanism 16 loosened, the punch ring 18 and die ring 26 are laterally positioned along the respective shafts 52, 28 as desired. The adjustment tool 122 is useful in laterally positioning the rings 18, 26, relative the shafts 52, 28. For example, the die ring 18 is repositioned by inserting the adjustment tool 122 into the die ring passageway 38 until the sprocket end 124 of the tool 122 engages the teeth 32 of the key bar 30. Axial rotation of the adjustment tool 122 thus imparts a lateral movement of the die ring 26 relative to the die shaft 28 via a rack and pinion type action. With the die ring 26 positioned as desired, the tool 122 is then inserted in the punch ring passageway 61 for engagement with the teeth 56, with the tool 122 axially rotated to laterally position the punch ring 18 in such a manner that it is substantially aligned and coplanar with the die ring 26. In this regard, it has been found useful to use a straight edge in a vertical orientation and abutting the rings 18, 26 to insure relatively precise alignment between the rings. With the rings 18, 26 aligned, the locking keys 40, 64 are tightened and then the shaft set screws are tightened (e.g. using an allen wrench) to complete the locking fit of the rings 18, 26 to the shafts 52, 28.

The operator next selects the desired configuration of the punching apparatus 20 of the punch mechanism 14 by operating the shifting structure 22 thereof. No adjustment of the die ring 26 is necessary, as the die ring is configured to accommodate any of the punch patterns selectable on the punch ring (a two hole pattern or three hole pattern is available in the preferred embodiment). Turning to FIG. 1, a three hole pattern has been selected. First, the operator positioned the adjustment tool 122 in the tool reception cavity 76 until the sprocket 124 engages the teeth 110 of the outermost camming ring 102. The outermost camming ring 102 is axially rotated (clockwise viewing FIG. 1) until the slot 118 of the camming ring 102 engages the pin 116 preventing further rotation of the ring 102. As seen in FIG. 1, in this position, the three driving surfaces 108 engage the cam followers 92 of three of the punching apparatuses 20. Thus, three of the punches 80 are positioned in their punching position by the camming ring 102.

Next, the operator inserted tool 122 into the tool reception cavity 74 until the sprocket 124 passed through the outermost camming ring 102 (through the cutout portion 114) and engaged the teeth 112 of the innermost ring 104. The innermost camming ring 104 has been rotated (counterclockwise viewing FIG. 1) until the pin 116 engages the end of the slot 120 of the innermost camming ring 104. It will be appreciated that slot 120 is dimensioned such that rotation of ring 104 is stopped by pin 116 when ring 104 is properly positioned for the three hole punch pattern illustrated in FIG. 1. That is, with the innermost camming ring 104 positioned as shown in FIG. 1, the driving surfaces 108 of the camming ring 104 do not engage any of the cam followers 92 of the punching apparatus 20. In this configuration, one of the punches 80 (the top punch viewing FIG. 1) is not engaged by any of the driving surfaces 108 of either of the camming rings 102, 104, and thus is biased into its retracted position by the belleville springs 90 operating against the respective cam follower 92.

FIGS. 2–5 illustrate the cooperative engagement of the punching apparatuses 20 with the shifting structure 22 in more detail. That is, FIG. 3 illustrates a punch 80 in the retracted position and the relative orientation of the retracted punch 80 to a die insert 48 when aligned at the nip between the two rings 18, 26. As seen in FIG. 3, neither the outermost camming ring 102 nor the innermost camming ring 104 engage the illustrated cam follower 92 with a driving surface 108. Thus, the punch 80 is not positioned into the punching position, with the belleville springs 90 biasing the punch 80 into the retracted position. Advantageously, the cap screw 100 retains the punch 80 in the cam follower 92, and for this purpose, slot 78 is provided and allows the cap screw 100 to move as necessary in the slot 78 corresponding to movement of the punch 80 between the retracted and punching positions. FIG. 3 further illustrates that in the retracted position the punch 80 will not penetrate the web 12 and into the die insert 48.

FIG. 4 illustrates the engagement of the adjustment tool 122 with the outermost camming ring 102. In this regard, a comprison of FIGS. 1 and 4 is useful. It is readily appreciated, that the tool reception cavity 76 is adjacent the groove 70 such that with the tool 122 received in the cavity 76, the sprocket 124 will engage the teeth 110 of the outermost camming ring 102. FIG. 5 is similar to FIG. 4, but illustrates tool reception cavity 74 juxtaposed to the groove 70 for the operation of the innermost camming ring 104. Thus, the tool 122 is inserted in the cavity 74 with the cutout portion 114 allowing the sprocket 124 to clear the outermost camming ring 102 whereby the sprocket 124 engages the teeth 112 of the innermost camming ring 104.

Turning to FIG. 2, a comparison between FIGS. 2 and 3 is useful in illustrating the shearing operation of the punch 80 as it passes through the web 12 into the die insert 48. FIG. 2 illustrates the lowermost punch 80 in the punching position. As seen in FIG. 2, the outermost camming ring 102 has a driving surface 108 in operative engagement with the cam follower 92, thereby compressing the belleville springs 90 and forcing the punch 80 into the punching position. In this position, the cap screw 100 is repositioned in the slot 78 as necessary. In FIG. 2, the punch unit 10 is illustrated at that point in time when the punch 80 has extended through the web 12 shearing a hole therethrough, with the punch 80 extending slightly into the aperture of the die insert 48. The web chad produced by the punching operation is forced downwardly and away by the chad disposal chute 44.

FIG. 1 is useful in appreciating the overall operation of the punch unit 10. That is, web 12 moves along a path of travel (left to right in FIG. 1), with the die mechanism 16 rotating (clockwise in FIG. 1) while the punching mechanism 14 rotates (counterclockwise in FIG. 1). As can be appreciated, the punch and die mechanism 14, 16 rotate co-speed such that a die insert 48 is always aligned with a corresponding punch 80 when the respective punch 80 and die insert 48 are aligned at the nip between the two rings 18, 26. Thus, the die mechanism 16 is always in the proper position for punching operation, allowing the operator to extend or retract the punches 80 without regard to adjusting the die mechanism 16. While FIG. 1 illustrates a setup for a three hole punch pattern in a given length of web, it is a simple matter to change the configuration of the punching mechanism 14 to a two hole punch pattern for the same length of web. That is, if the innermost camming ring 104 were rotated clockwise as seen in FIG. 1, the driving surfaces 108 of the innermost camming ring 104 would then engage the cam followers 92 of the uppermost and lowermost (circumferentially opposed) punches forcing the respective punches 80 into the punching position. From this position, the outermost camming ring 102 can then be rotated in a counterclockwise direction whereby the driving surfaces 108 of the camming ring 102 will disengage from all of the cam followers 92. This movement of the camming ring 102 allows two punches 80 (at the 10:00 o'clock and 2:00 o'clock position as seen in FIG. 1) to be radially inwardly biased into the retracted position by the respective belleville springs 90.

As those skilled in the art will readily appreciate, the invention hereof encompasses many alternative embodiments without departing from the scope of the present invention. That is, one such variation would include simply one camming ring having driving surfaces spaced thereon as necessary to produce the desired hole punch pattern. Further, more than two camming rings might be incorporated into the punch ring to produce a variety of different hole punch patterns. Additionally, the punch ring might include annular grooves in each axial face with corresponding camming rings and punches for each groove. Further, it can be readily appreciated that a large number of punches 80 might be operatively received around the punch ring depending upon job requirements, with the punches 80 of different sizes. In short, it is apparent that the number of permutations of hole punch patterns and hole sizes available is simply dependent upon the number and arrangement of punches in the punch ring and the number and configuration of corresponding camming rings.

I claim:

1. Apparatus for punching a pattern of holes in a web moving along a path of travel, said apparatus comprising:

an annular die ring rotatably mounted on one side of said path of travel and presenting a plurality of spaced-apart, radially oriented dies mounted to said ring;

an annular punch ring rotatably mounted on the other side of said path of travel and presenting structure defining a plurality of spaced-apart, radially oriented bores extending from the outermost surface of said punch ring into said ring;

punching means operatively received in each bore and having a distal shearing end, said punching means being shiftable between an outermost, punching position and an innermost, retracted position;

means for biasing said punching means towards said retracted position;

control means movable to and from a location for selectively shifting certain of said punching means and retaining said certain of said punching means in said punching position while the control means is in said location thereof such that said certain of said punching means are positioned in said punching position and the remaining punching means are retained in said retracted position, said control means being operable to fixedly retain said certain of said punching means in said punching position during the entire rotational path of travel of said punch ring; and means for rotating said punch and die rings whereby said certain of said punching means in the punch position engage said moving web and extend into a complementally aligned die thereby shearing said web and creating a hole therethrough, the said certain of said punching means in the punch position providing the desired pattern of holes in the web.

2. A punch ring as set forth in claim 1, said punch biasing means including a spring operatively disposed within said bore and engaging said punch means.

3. Apparatus for punching a pattern of holes in a web moving along a path of travel, said apparatus comprising:

an annular die ring rotatably mounted on one side of said path of travel and presenting a plurality of spaced apart, radially oriented dies mounted to said ring;

an annular punch ring rotatably mounted on the other side of said path of travel and presenting structure defining an annular, concentric groove in one axial face of said punch ring;

structure defining a plurality of spaced apart, radially oriented bores extending from the outermost surface of said ring to said groove;

punching means operatively received in each bore and having a distal shearing end;

said punching means being shiftable between an outermost, punching position and an innermost retracted position, said punching means including an innermost cam follower end remote from said shearing end, with said follower end extending into said groove when said punching means is in said retracted position;

means for biasing said punching means towards said retracted position;

means for selectively shifting said punching means into said punching position whereby one or more of said punching means are positionable into said punching position and the remaining punching means retained in said retracted position, said shifting means including one or more annular camming rings operatively received in said groove, said camming ring presenting an outermost camming face adjacent said bores and one or more radially-outwardly extending, undulate driving surfaces on said camming face, said shifting means having means for selectively axially rotating said camming ring whereby one or more of said punching means can be shifted into said punching position by engagement of said driving surface with the respective cam follower end of said punching means, said camming ring including a plurality of teeth along a portion thereof whereby a complemental sprocket tool will axially rotate said camming ring; and means for rotating said punch and die rings whereby the punching means in the punch position engage said moving web and extend into a complementally aligned die thereby shearing said web and creating a hole therethrough, the punching means in the punch position providing the desired pattern of holes in the web.

4. A punch ring as set forth in claim 3, said punch shifting means including two camming rings presenting an innermost ring and an outermost ring, said outermost ring having an inwardly-extending cutout portion adjacent said outermost camming face thereby exposing said teeth of said innermost ring for the complemental reception of a sprocket tool.

5. A punch ring device, comprising:

a rotatable, annular support ring having structure defining a plurality of radially-oriented, circumferentially spaced-apart, elongated bores therein;

a plurality of elongated punch means, each punch means operatively received in a respective bore and operably shiftable between an extended, punching position and a retracted, inoperative position;

means for radially-inwardly biasing said punch means into said retracted position; and means for selectively radially-outwardly shifting certain of said punch means into said punching position while the remaining punch means are retained in said retracted position, said shifting means being operable to fixedly retain said certain punch means in said punching position during the entire rotational path of travel of said support ring.

6. A punch ring device, comprising:

an annular support ring having structure defining a plurality of radially-oriented, circumferentially spaced-apart, elongated bores therein;

a plurality of elongated punch means, each punch means operatively received in a respective bore and operably shiftable between an extended, punching position and a retracted inoperative position;

means for radially-inwardly biasing said punch means into said retracted position; and means for selectively radially-outwardly shifting one or more of said punch means into said punching position, said support ring having structure defining an annular, groove thereon and said bores extending from said support ring outermost surface to said groove;

said punch means presenting an outwardly-oriented punch face at one end thereof and a cam follower at the other end thereof adjacent said support ring groove; and said punch shifting means including one or more annular camming rings operatively received in said groove, said camming ring having an outermost camming face presenting one or more radially outwardly-extending, undulate driving surfaces, said punch shifting means having means for selectively axially rotating and positioning said camming ring for engaging one of said cam followers with a respective driving surface thereby outwardly shifting the respective punch means into said punching position.

7. A punch ring as set forth in claim 6, said punch biasing means including a spring operatively disposed within said bore and engaging said punch means.

8. A punch ring as set forth in claim 6, said camming ring including a plurality of teeth along a portion thereof.

9. A punch ring as set forth in claim 8, said punch shifting means including two camming rings presenting an innermost ring and an outermost ring, said outermost ring having an inwardly-extending cutout portion adjacent said outermost camming face thereby exposing a portion of said teeth of said innermost ring.

10. A punch ring as set forth in claim 6, said support ring including an elongated pin orthogonally secured within said groove and said camming ring presenting structure defining an arcute slot extending through said camming ring whereby said pin is operatively received within said slot and limits the amount of axial rotation of said camming ring.

11. Apparatus for punching a pattern of holes in a web moving along a path of travel, said apparatus comprising:

an annular die ring rotatably mounted on one side of said path of travel and presenting a plurality of spaced apart, radially oriented dies mounted to said ring;

an annular punch ring rotatably mounted on the other side of said path of travel and presenting structure defining an annular, concentric groove in one axial face of said punch ring;

structure defining a plurality of spaced apart, radially oriented bores extending from the outermost surface of said ring to said groove;

punching means operatively received in each bore and having a distal shearing end;

said punching means being shiftable between an outermost, punching position and an innermost retracted position, said punching means including an innermost cam follower end remote from said shearing end, with said follower end extending into said groove when said punching mens is in said retracted position;

means for biasing said punching means towards said retracted position;

means for selectively shifting said punching means into said punching position whereby one or more of said punching means are positionable into said punching position and the remaining punching means retained in said retracted position, said shifting means including one or more annular camming rings operatively received in said groove, said camming ring presenting an outermost camming face adjacent said bores and one or more radially-outwardly extending, undulate driving surfaces on said camming face, said shifting means having means for selectively axially rotating said camming ring whereby one or more of said punching means can be shifted into said punching position by engagement of said driving surface with the respective cam follower end of said punching means, said shifting means being operable to fixedly retain said certain of said punching means in said punching position during the entire rotational path of travel of said punch ring; and means for rotating said punch and die rings whereby the punching means in the punch position engage said moving web and extend into a complementally aligned die thereby shearing said web and creating a hole therethrough, the punching means in the punch position providing the desired pattern of holes in the web.

12. A punch ring as set forth in claim 11, said punch ring including an elongated pin orthogonally secured within said groove and said camming ring presenting structure defining an arcuate slot extending through said camming ring whereby said pin is operatively received within said slot and limits the amount of axial rotation of said camming ring.

* * * * *